US007959350B2

(12) United States Patent
Oppliger et al.

(10) Patent No.: US 7,959,350 B2
(45) Date of Patent: Jun. 14, 2011

(54) CHRONOGRAPH

(75) Inventors: Laurent Oppliger, Les Geneveys-sur-Coffrane (CH); Alain Girardbille, La Chaux-de-Fonds (CH); Valérien Jaquet, La Chaux-de-Fonds (CH)

(73) Assignee: Jean-Pierre Jaquet, La Chaux-de-Fonds (CH)

( * ) Notice: Subject to any disclaimer, the term of this patent is extended or adjusted under 35 U.S.C. 154(b) by 0 days.

(21) Appl. No.: 12/519,419

(22) PCT Filed: Nov. 28, 2007

(86) PCT No.: PCT/IB2007/003653

§ 371 (c)(1),
(2), (4) Date: Dec. 16, 2009

(87) PCT Pub. No.: WO2008/075147

PCT Pub. Date: Jun. 26, 2008

(65) Prior Publication Data

US 2010/0097898 A1 Apr. 22, 2010

(30) Foreign Application Priority Data

Dec. 18, 2006 (CH) ..... 2049/06

(51) Int. Cl.
*G04F 7/06* (2006.01)

(52) U.S. Cl. ..... 368/106; 368/101

(58) Field of Classification Search ..... 368/101–106
See application file for complete search history.

(56) References Cited

U.S. PATENT DOCUMENTS

| | | | | |
|---|---|---|---|---|
| 3,890,779 | A | 6/1975 | Capt et al. | |
| 4,364,669 | A * | 12/1982 | Thoenig et al. | 368/111 |
| 7,441,945 | B2 * | 10/2008 | Laucella et al. | 368/190 |
| 7,445,374 | B2 * | 11/2008 | Forsey et al. | 368/101 |
| 2007/0206447 | A1 * | 9/2007 | Hiraya et al. | 368/112 |

FOREIGN PATENT DOCUMENTS

| | | |
|---|---|---|
| CH | 283491 | 6/1952 |
| CH | 309240 | 8/1955 |

OTHER PUBLICATIONS

"Aus dem Tal der Tüftler", Uhren Juwelen Schmuck, Bielefelder Verlagsanstalt K.G. Bielefeld, Apr. 1, 1998, pp. 78-85, XP-000750647.
International Search Report dated Jul. 14, 2008.

* cited by examiner

*Primary Examiner* — Sean Kayes
(74) *Attorney, Agent, or Firm* — Young & Thompson

(57) ABSTRACT

The control mechanism of a simple three-cycle chronograph includes a single pusher (A) that acts on a shuttle (1) of a chronograph cam. The mechanism can include a display (17, 18) of the state of the chronograph.

16 Claims, 7 Drawing Sheets

Prior Art

Prior Art

CHRONOGRAPH

This invention relates to chronographs and to wristwatches or pocket watches comprising the chronograph function, whether this function is incorporated in the watch's movement or forms part of an additional module.

BACKGROUND OF THE INVENTION

Several types of chronographs, such as the simple three-cycle chronograph or the two-cycle double-pusher chronograph whose mechanisms use a column wheel, are known. These are cumbersome embodiments, and their assembly requires highly skilled workers.

Double-pusher shuttle chronographs, without column wheels, in which the starting and stopping are produced by successively depressing the first pusher and the resetting to zero is produced by depressing the second pusher, are also known. These shuttle chronographs are less cumbersome and easier to assemble and to regulate. The ETA 7750 caliber that is well known to all watchmakers is such a shuttle chronograph and is used by numerous watch manufacturers.

DESCRIPTION OF THE RELATED ART

FIGS. 1 to 6 illustrate the various positions of the shuttle of an ETA 7750 chrono with two pushers during a complete cycle—zero, start, stop, re-start, stop, reset, zero—under the action of successively depressing the first pusher and then of depressing the second pusher for the resetting to zero. FIG. 7 is a generally diagrammatic view of the well-known ETA 7750 caliber.

SUMMARY OF THE INVENTION

The object of this invention is to modify such a shuttle chronograph with two pushers into a simple shuttle chronograph with only one pusher, i.e., a single-pusher cam chronograph. Actually, the experts are seeking to produce a chronograph with one pusher to make a return to former chronographs while using the simplicity of design and adjustment of a shuttle chronograph in contrast to column-wheel chronographs.

Another object of this invention is to allow a display of the state of the chronograph; operating, stopped, reset.

This invention has as its object the production of a chronograph with a pusher that is distinguished by the characteristics listed in Claim 1.

BRIEF DESCRIPTION OF THE DRAWINGS

The accompanying drawing partially illustrates the mechanism of the chronograph with a pusher according to the invention in its various positions during the operating cycle. In these depictions, the modified parts of the ETA 7750 chronograph movement mechanism have been illustrated; certain parts are not shown since the remainder of the design of the mechanism of the chronograph is that of said well-known ETA 7750 caliber.

DETAILED DESCRIPTION OF THE PREFERRED EMBODIMENTS

Figure 1:
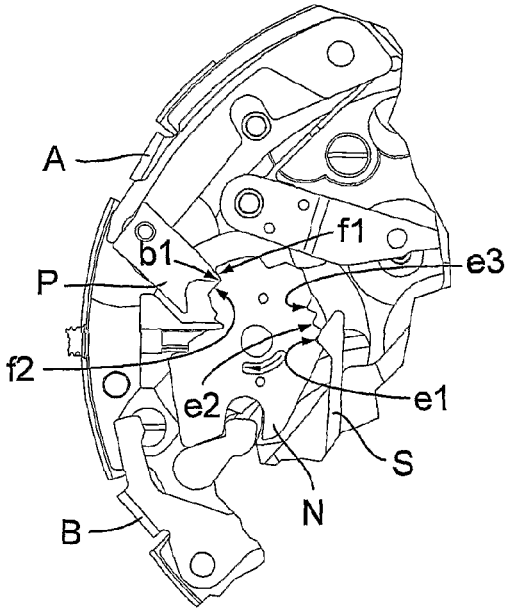
FIGS. 1 to 6 illustrate a cycle of operation of a shuttle chronograph with two pushers and the positions that the shuttle of this mechanism takes during this cycle, as produced in the ETA 7750 caliber, for example.

FIG. 1 illustrates the control mechanism of the chronograph at zero position or after a reset. The shuttle N is immobilized in an angular position for which the jumper S is engaged with a first notch e1 of the shuttle. The pushers A and B are in retracted position; the oscillating follower P of the pusher A is resting with its first nose b1 in the angle that is formed by the faces f1 and f2 of the periphery of the shuttle.

Figure 2:
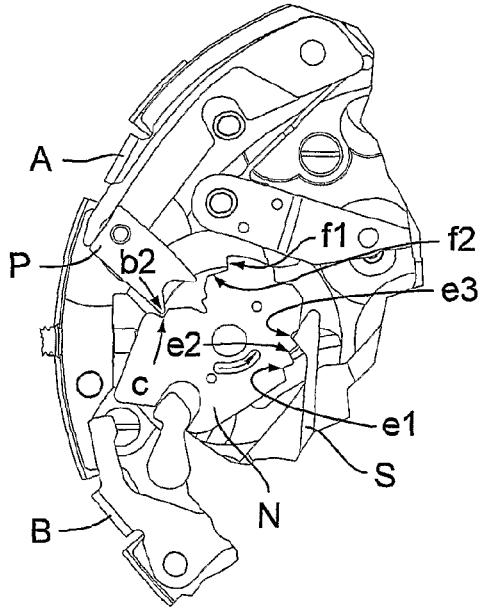
Prior Art Fig.2

By first depressing the pusher A then by releasing the latter, the control mechanism of the chronograph makes the transition from the position that is illustrated in FIG. 1 to the one that is illustrated in FIG. 2. The shuttle N is moved by two catches in a clockwise direction and is kept in this position by the jumper S that works with the notch e3. By moving back into its rest position, the pusher A entrains the oscillating follower P whose second nose b2 is placed within the catch c of the periphery of the shuttle. This position of the control mechanism corresponds to the operational state of the chronograph.

Figure 3:
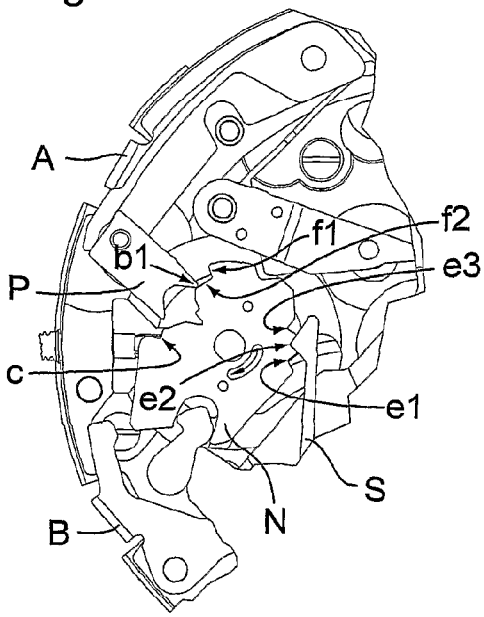
Prior Art Fig.3

A second depressing of the pusher A followed by a release of the latter causes the transition of the chronograph control mechanism from its position illustrated in FIG. 2 to its position illustrated in FIG. 3 corresponding to the stopping of the chronograph.

The nose b2 of the follower P pivots the shuttle N by one catch in a counterclockwise direction, and the shuttle is kept in position by the jumper S that is engaged in notch e2. The nose b1 of the oscillating follower P of the pusher A is placed opposite the face f2 of the shuttle N.

Figure 4:
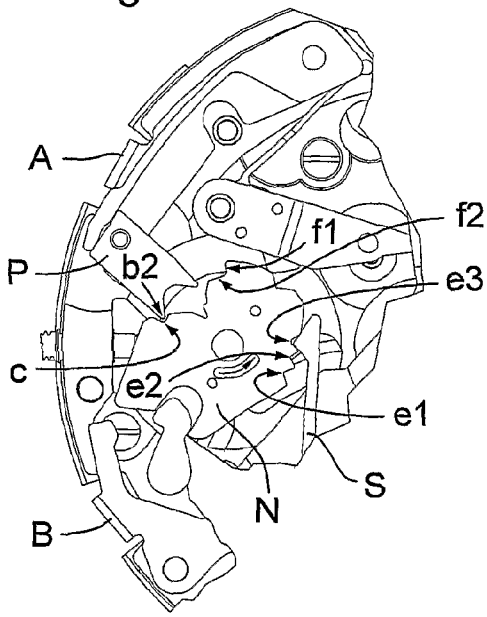
Prior Art Fig.4

A new depressing of the pusher A that is followed by its release causes a sliding of the first nose b1 of the oscillating follower P on the face f2 of the shuttle until it abuts against the face f1 of the latter and then drives this shuttle N in a clockwise direction, whereby the jumper S comes to work with the notch e3 of the shuttle. The follower P returns to a position where its second nose b2 is opposite the catch c of the shuttle. The transition has been made from the position that is illustrated in FIG. 3, the chronograph stopped, to the one that is illustrated in FIG. 4, corresponding to a new state of operation of the chronograph.

Figure 5:
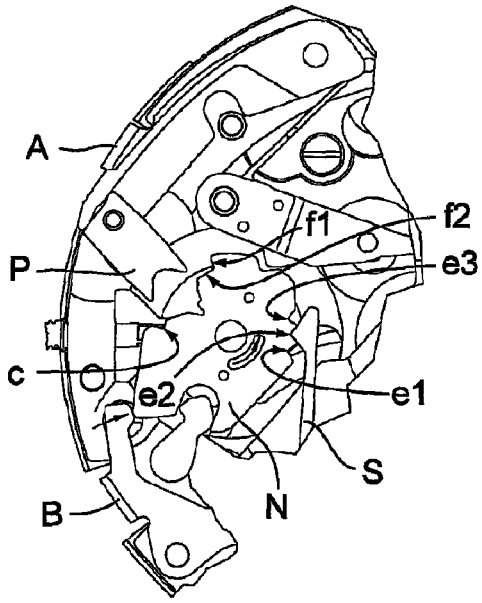

A new depressing of the pusher A tilts the shuttle by one catch in a counterclockwise direction and places the control mechanism of the chronograph in a position that is illustrated in FIGS. 3 and 5 corresponding to the stopping of the chronograph.

Figure 6:
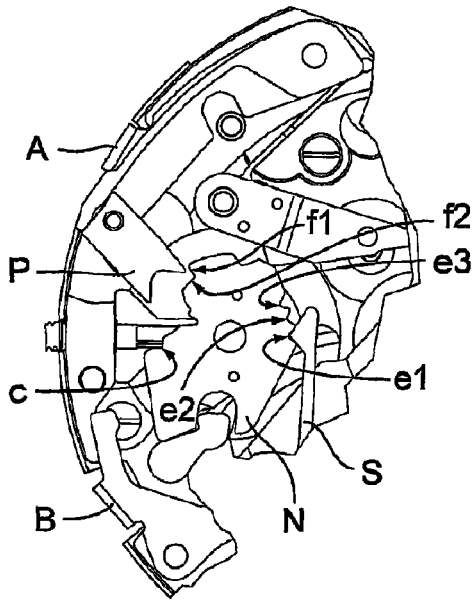
Prior Art Fig.6

Next, successively depressing the pusher A shifts the control mechanism of the chronograph into successive positions that correspond to the operation (FIG. 4), then to stopping (FIG. 5) and so on until the time when the user wants to carry out a resetting to zero starting from a position for which the chronograph is stopped. To do this, the user rests on the second pusher B, causing the movement of a catch in a counterclockwise direction of the shuttle N that returns to zero position for which the jumper S works with the first notch e1 (transition from the position illustrated in FIG. 5 up to the position illustrated in FIG. 6).

Figure 7:
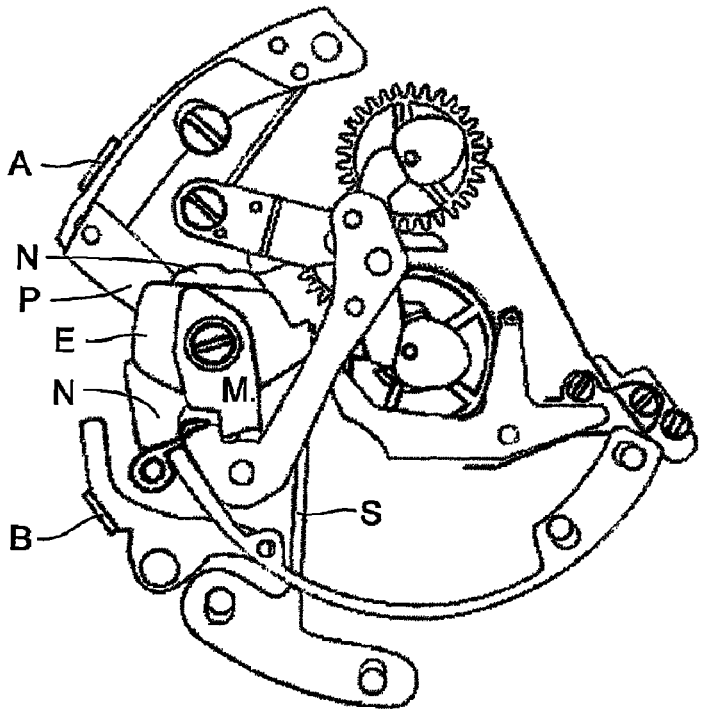
Prior Art Fig.7

As can be seen diagrammatically in FIG. 7, the shuttle N is integral in an angular manner with a clutch cam E and a hammer cam M, whereby the shuttle N and these two cams E, M form the chronograph cam, which controls the chronograph mechanism in a known way.

The object of this invention is to create a control mechanism of a simple chronograph with a shuttle, therefore with a single pusher, ensuring the control of the operation, stopping, and resetting to zero of the chronograph mechanism. Another object of this invention is to provide on the timepiece—equipped with such a simple chronograph with a shuttle—a display of the state of the chronograph mechanism.

To achieve these objects while using an ETA 7750-based movement, the control mechanism of the chronograph has been modified in that the second pusher B has been eliminated or made inoperative, the shuttle has been modified just like the oscillating follower of the first pusher A to make possible the angular positioning of the shuttle into its three positions, stopped, running and resetting to zero using a single pusher.

Figure 8:
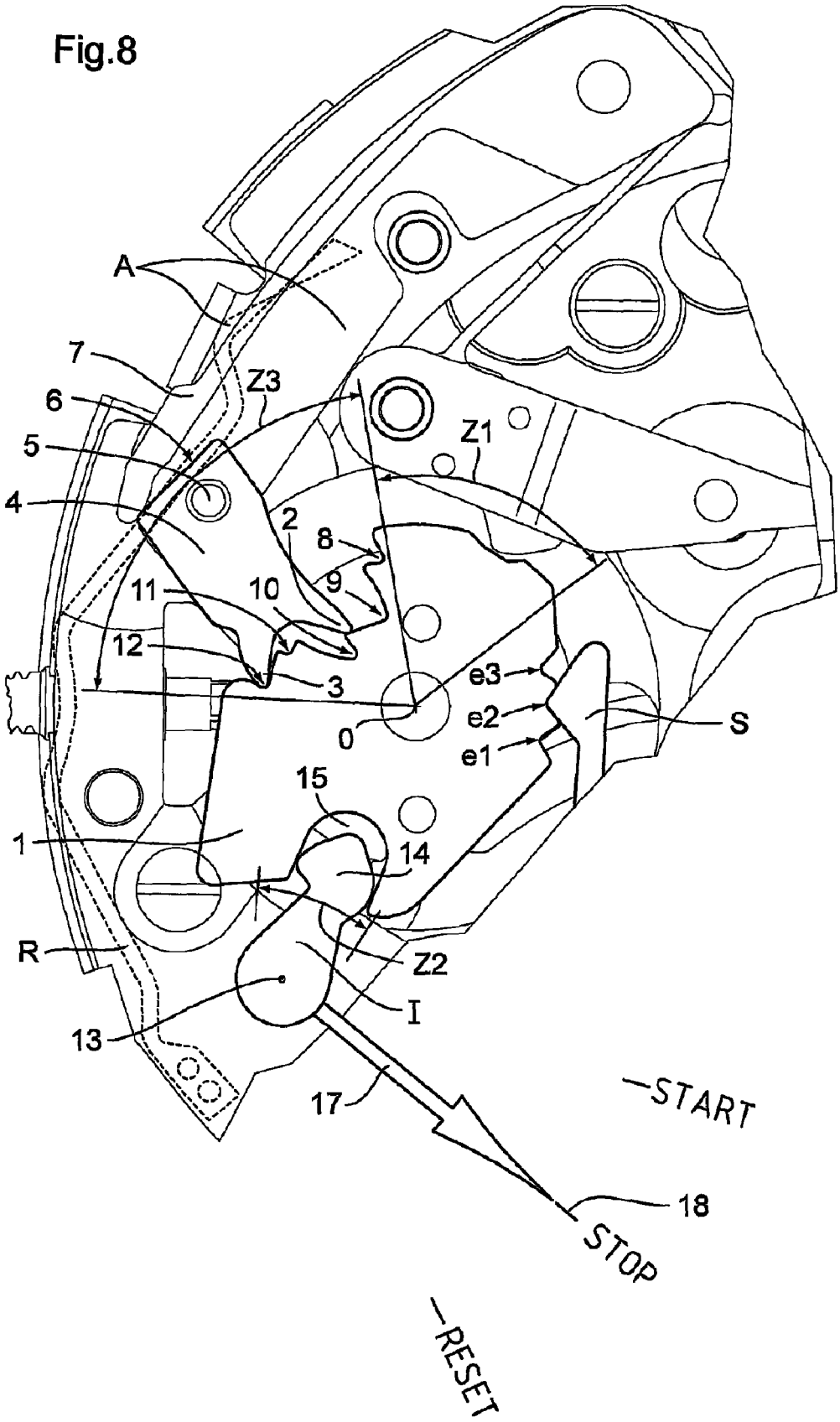
FIG. 8 illustrates—on a larger scale—the shuttle and the pusher of the chronograph control device according to the invention.

As in the ETA 7750 caliber, the shuttle 1 of this control device of a chronograph mechanism is pivoted around its center of rotation O, and its periphery comprises (see FIG. 8):

An indexing zone that is equipped with three notches e1, e2, e3 working with a jumper S for the angular positioning of this shuttle 1 in its three operating positions, A zone z1 for control of a brake, and A zone Z2 for control of a switch I.

On its periphery, this shuttle 1 also comprises a thrust zone Z3 that works with two noses 2, 3 of an oscillating follower 4 pivoted at 5 on the pusher A whose rear section 6 rests on the end of the spring 7 that is attached to the rocker that carries the pusher A that is used to reset this follower 4 in a rest position between each actuation of the pusher A, a rest position for which the follower 4 rests at two points against the spring 7 by its rear section. The shape of this peripheral thrust zone Z3 just like the shape of the noses 2, 3 are particular for allowing the three-cycle operating cycle of a simple chronograph with a single pusher.

The peripheral thrust zone Z3 of the shuttle 1 comprises slots: in the illustrated example, five slots 8, 9, 10, 11 and 12, whose first two 8, 9 work during the operation with the first nose 2 of the follower 4 and the three others 10 to 12 with the second nose 3 of this follower 4. The first, third and fifth slots 8, 11 and 12 have approximately rectilinear sides while the second and third slots 9 and 10 have approximately rectilinear internal sides and concave external sides.

The noses 2, 3 of the follower 4 comprise approximately rectilinear internal sides and convex external sides that have a curvature corresponding to that of the external sides of the second and third slots 9 and 10 of the shuttle 1.

The switch I is pivoted around its shaft 13 and comprises a head 14, portions of whose perimeter rest against the rectilinear sides of a U-shaped cutaway 15 of the shuttle 1 that is located in the control zone Z2 of its periphery. The shaft 13 of the switch passes through the timepiece and passes through the dial 16 of the latter. This shaft 13 carries a hand 17 that works with a graduation 18 of the dial 16 that makes it possible to indicate the state of the chronograph mechanism: stopping, operating, or return to zero.

FIGS. 9 to 14 illustrate the operating cycle of the control mechanism of the simple chronograph with a shuttle according to the invention.

Figure 9:
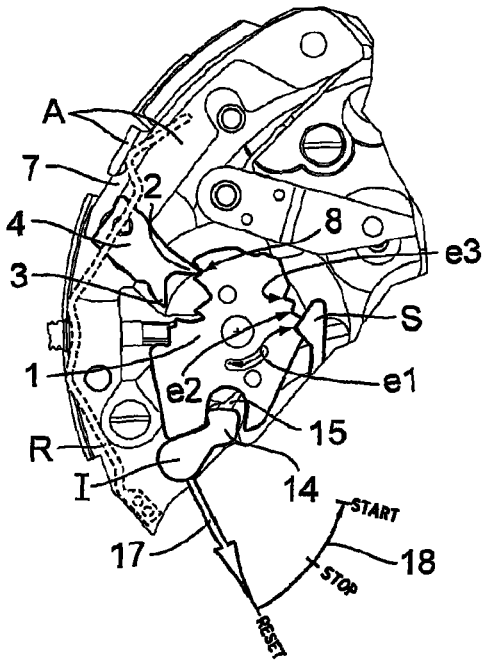
FIG. 9 illustrates the position of the shuttle in the zero or reset state of the chronograph, whereby the single pusher is in inactive position.

The zero position, for rest or reset of the chronograph, is illustrated in FIG. 9. In this position, the shuttle 1 is kept in its zero position by the jumper S that is engaged with the notch e1 of the shuttle 1. The switch I is held by the cutaway 15 of the shuttle 1 in a position for which the hand 17 that carries its shaft 13 is opposite the position for resetting the graduation 18 of the dial 16 to zero.

The pusher A is held in retracted position by a control spring R, and the first nose 2 of the oscillating follower 4 is engaged in the first slot 8 of the shuttle 1, whereby the oscillating follower 4 is in a position of rest for which its rear segment rests against the spring 7 at two points.

Figure 10:
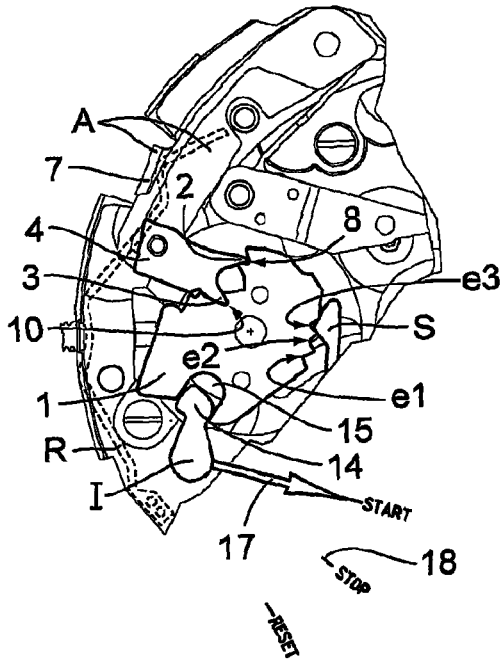
FIG. 10 illustrates the position of the shuttle in the operating state of the chronograph, whereby the single pusher is at the end of travel of the first thrust of a cycle.
Figure 11:
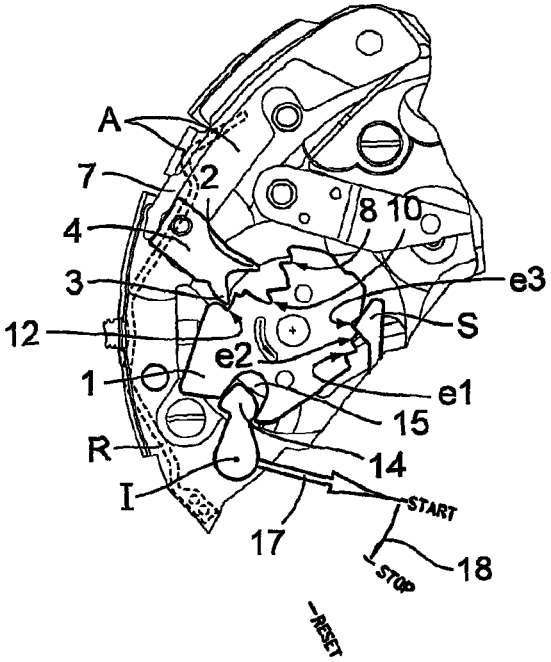
FIG. 11 illustrates the position of the shuttle in the operating state of the chronograph, the single pusher being returned to inactive position.

Starting from this zero position, the control mechanism of the chronograph passes into operating position of the chronograph that is illustrated in FIG. 10 by a pressure that is exerted on the pusher A. The first nose 2 of the follower 4 pushes the two-catch shuttle 1 in a clockwise direction until the jumper S is engaged in the notch e3 of the shuttle. For this position, at the end of travel of the pusher A, the second nose 3 of the follower 4 is engaged at the bottom in the third slot 10 of the shuttle, whereby the bent side of this second nose 3 abuts against the concave side of this slot 10, which prevents any subsequent angular movement of the shuttle 1 in a clockwise direction beyond this operating position of the chronograph control mechanism, corresponding to the operation of the chronograph. The switch I has been moved angularly in a counterclockwise direction by the cutaway 15 of the shuttle, and the hand 17 points to the initial or starting position of the graduation 18. The user releases the pusher A that returns to rest position under the action of its control spring R, see FIG. 11, for which the second nose 3 of the follower 4 is engaged in the fifth slot 12 of the shuttle 1.

Figure 12:
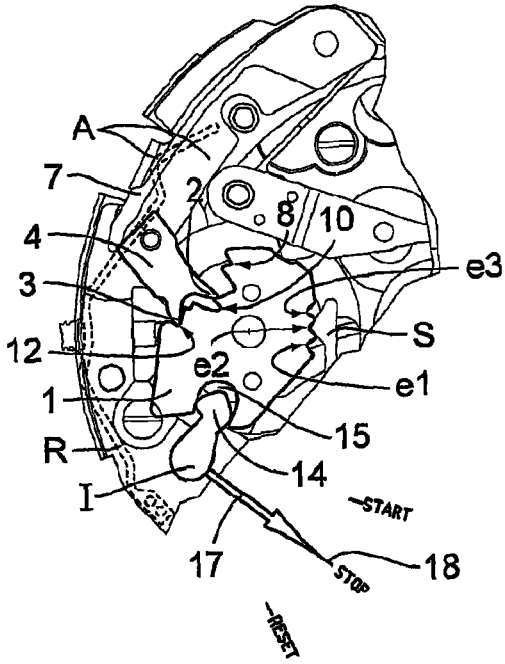
FIG. 12 illustrates the position of the shuttle when the chronograph is stopped, whereby the single pusher is at the end of travel of the second thrust of a cycle.

Starting from this operating position (FIG. 11), a second thrust of the user on the single pusher A causes—by the thrust of the second nose 3 of the follower 4 in the fifth slot 12 of the shuttle 1—the angular movement of a catch of this shuttle 1 in a counterclockwise direction up to the moment when the first nose 2 of the follower comes into contact with the rectilinear side of the second slot 9 of the shuttle. The contact of the two noses 2, 3 of the follower 4 with the section of the shuttle 1 locks the latter and prevents any subsequent angular movement of the latter. This angular stopping position of the shuttle 1 is held by the jumper S that is now engaged in the second notch e2 of the shuttle 1. The switch I was moved by the cutaway 15 of the shuttle, and its hand 17 came opposite the stop indication of the graduation 18 of the dial (16). The control mechanism is now in the position that is illustrated in FIG. 12 that corresponds to the stopping of the chronograph. The user then releases the pusher A that returns to the rest position under the action of its control spring R; the follower 4 then is positioned under the action of its spring 7 so that its first nose 2 is opposite the concave side of the second slot 9 of the shuttle and so that its second nose 3 is opposite the fourth slot 11 of the shuttle (FIG. 13).

Figure 13:
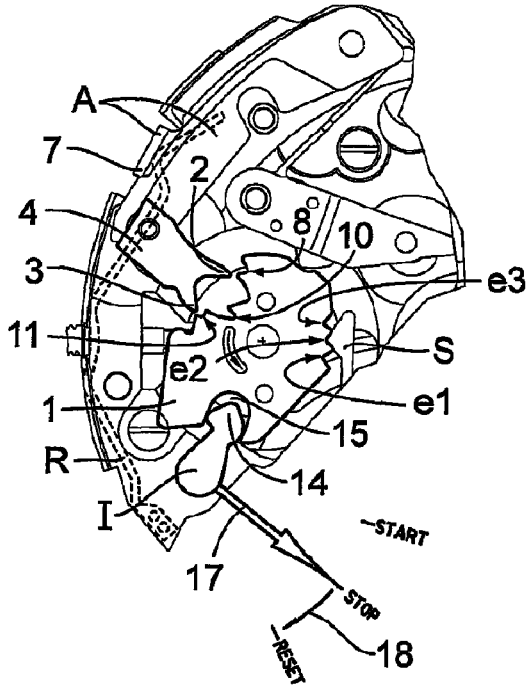
FIG. 13 illustrates the position of the shuttle when the chronograph is stopped, whereby the single pusher is returned to its inactive position.
Figure 14:
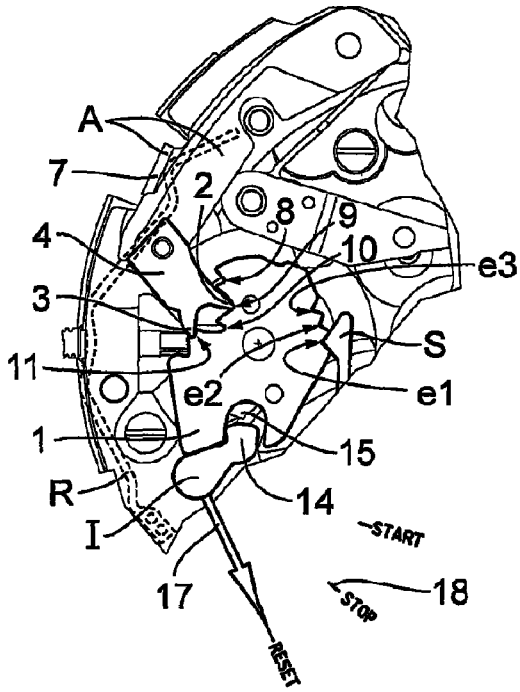
FIG. 14 illustrates the position of the shuttle in the zero or reset state of the chronograph, whereby the single pusher is at the end of travel of its third and last thrust of a cycle.

Starting from this stopping position of the control mechanism of a chronograph that is illustrated in FIG. 13, the user carries out a third depressing of the pusher A, the second nose 3 of the oscillating follower 4 comes into contact with the fourth slot 11 of the shuttle and moves the latter by one catch in a counterclockwise direction, this making the first nose 2 of this follower 4 slide along the concave side of the second slot 9 of the shuttle. When the pusher A is at the end of travel, the first nose 2 comes into contact with the rectilinear side of this second slot 9, and the angular position of the shuttle 1 is locked, whereby the two noses 2, 3 are in contact with the latter. The jumper S came to be located within the notch e1 of the shuttle and holds the latter in this zero position once the user has released the pusher A that returns to the rest position under the action of its control spring R. The switch I was moved during this last movement of the shuttle 1, and its hand 17 points to the zero indication or reset indication of the graduation 18 of the dial 16.

Of course, this particular shuttle 1 takes the place of the shuttle N in the ETA 7750-caliber chronograph cam and thus controls this chronograph mechanism.

In a variant, the display of the state of the chronograph can be eliminated. In this case, the hand 17 and the graduation 18 on the dial 16 are eliminated. The switch I is either eliminated or kept, but not used.

One particular advantage of this control mechanism of a chronograph with a simple shuttle, a pusher or a mono-pusher cam chronograph resides in the fact that each angular working position of the shuttle 1 is defined at the end of travel of the pusher by the contact of the two noses 2, 3 of the follower 4 against the section of the shuttle 1 that causes its angular locking. The jumper S therefore works with the notches e1, e2, and e3 for holding only the shuttle in its various positions but not for defining these positions.

The new chronograph control mechanism makes it possible for the first time to produce a three-cycle simple mono-pusher chronograph with a shuttle or with a cam and not with a column wheel, thus allowing a greater facility of production and adjustment.

The chronograph control mechanism that is described comprises a single pusher A that acts on a shuttle 1 that is part of the cam of the chronograph.

Figure 17:
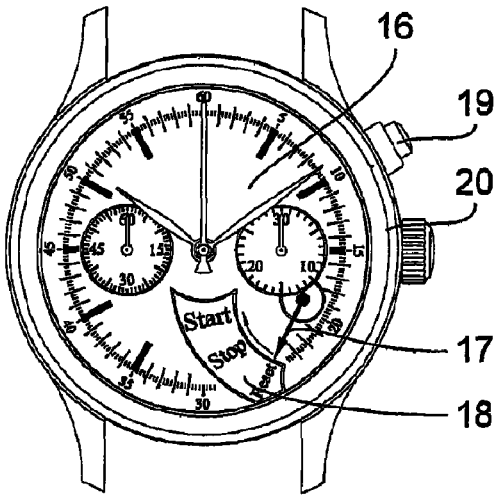
FIG. 17 is a front view of the timepiece that is illustrated in FIG. 15 in a variant that is equipped with a display of the state of the chronograph.

FIG. 17 illustrates, frontally, a chronograph according to this invention that comprises a display 17, 18 of the state of the chronograph, whereby the control mechanism of the chronograph is actuated by a maneuvering element 19 that passes through the timepiece box in an airtight way and is located at 2 o'clock. This maneuvering element 19 slides axially and makes it possible to actuate, starting from the outside of the watch box, the pusher A of the chronograph control mechanism that is described.

Figure 18:
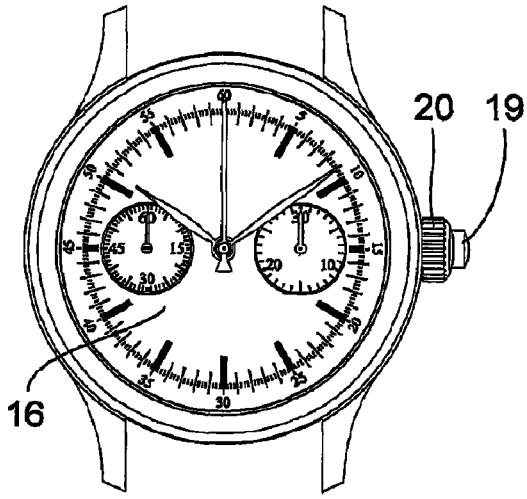
FIG. 18 is a front view of the timepiece that is illustrated in FIG. 16 in a variant without display of the chronograph state.

In the variant that is illustrated in FIG. 18, the chronograph does not comprise the display of its state. The maneuvering element 19 that actuates the pusher A of the chronograph control mechanism through the watch box is located in this variant concentrically to the reassembly ring 20.

Figure 15:
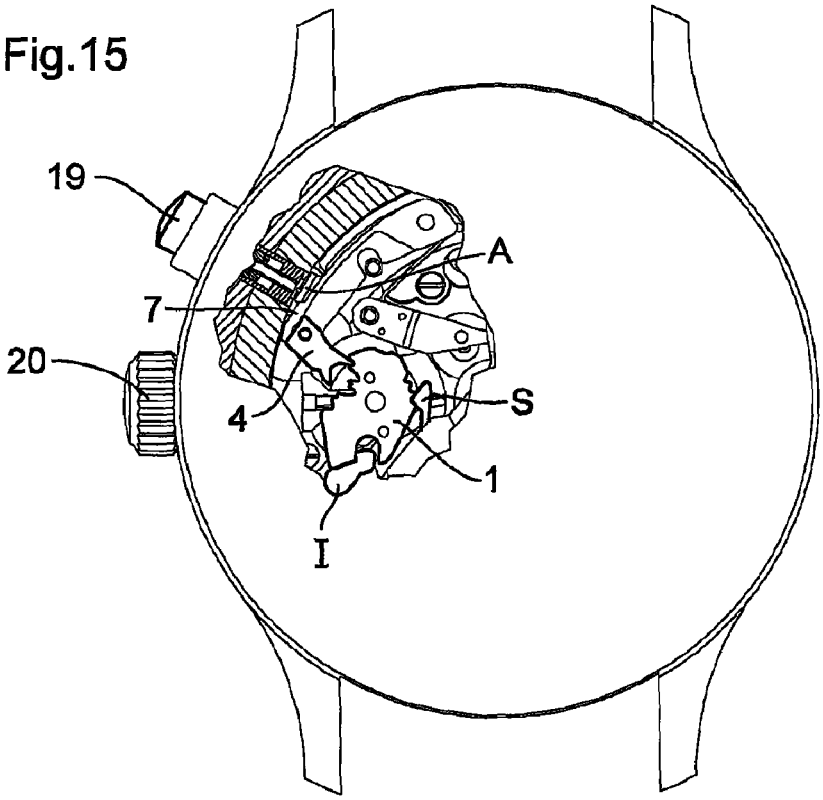
FIG. 15 illustrates a timepiece that comprises the chronograph movement according to the invention that is mounted so that the single pusher is actuated by a control element that passes through the watch box at 2 o'clock.

FIG. 15 is a view from the rear of the chronograph, partially exploded, showing the positioning of the chronograph movement in the watch box and the actuation of the pusher A by the maneuvering element 19 in the case where the latter is located at 2 o'clock.

Figure 16:
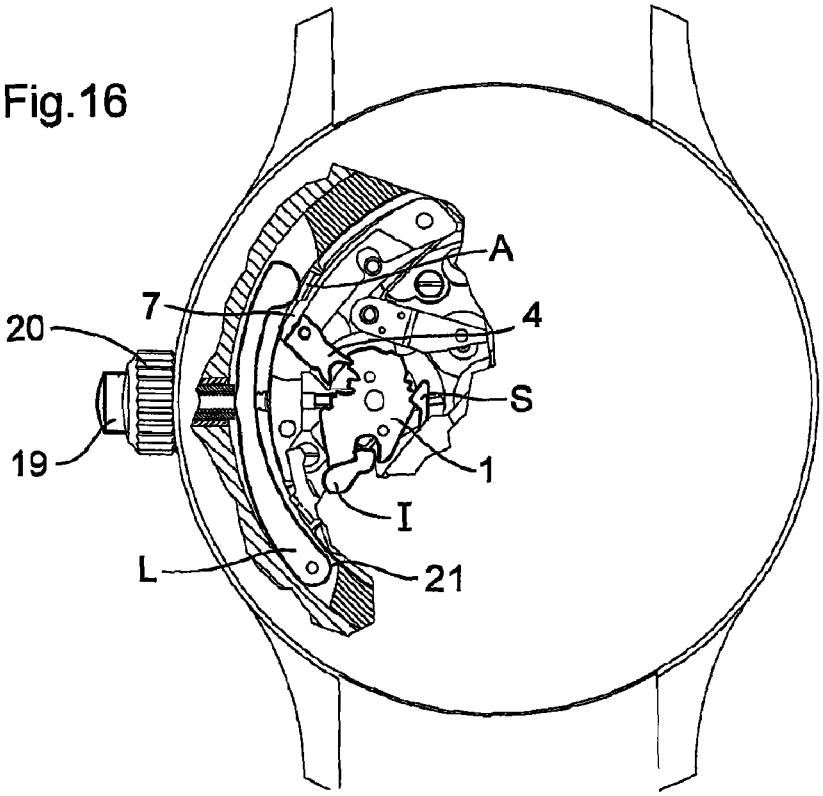
FIG. 16 illustrates a timepiece that comprises the chronograph movement according to the invention that is mounted such that the single pusher is actuated by a control element that passes through the watch box concentrically to the winder rod.

FIG. 16 is a view from the rear of the chronograph, partially exploded, showing the positioning of the chronograph movement in the watch box and the actuation of the pusher A by the maneuvering element 19 in the case where the latter is concentric to the winder rod. In this case, a lever L that is pivoted at 21 over the movement is actuated by the maneuvering element 19, and the free end of this lever L actuates the pusher A.

It is obvious that variants can be provided with a maneuvering element that is concentric to the winder ring with and without display of the state of the chronograph. Likewise, variants with the maneuvering element at 2 o'clock or any other location around the watch can be provided with and without display of the state of the chronograph.

Figure 19:
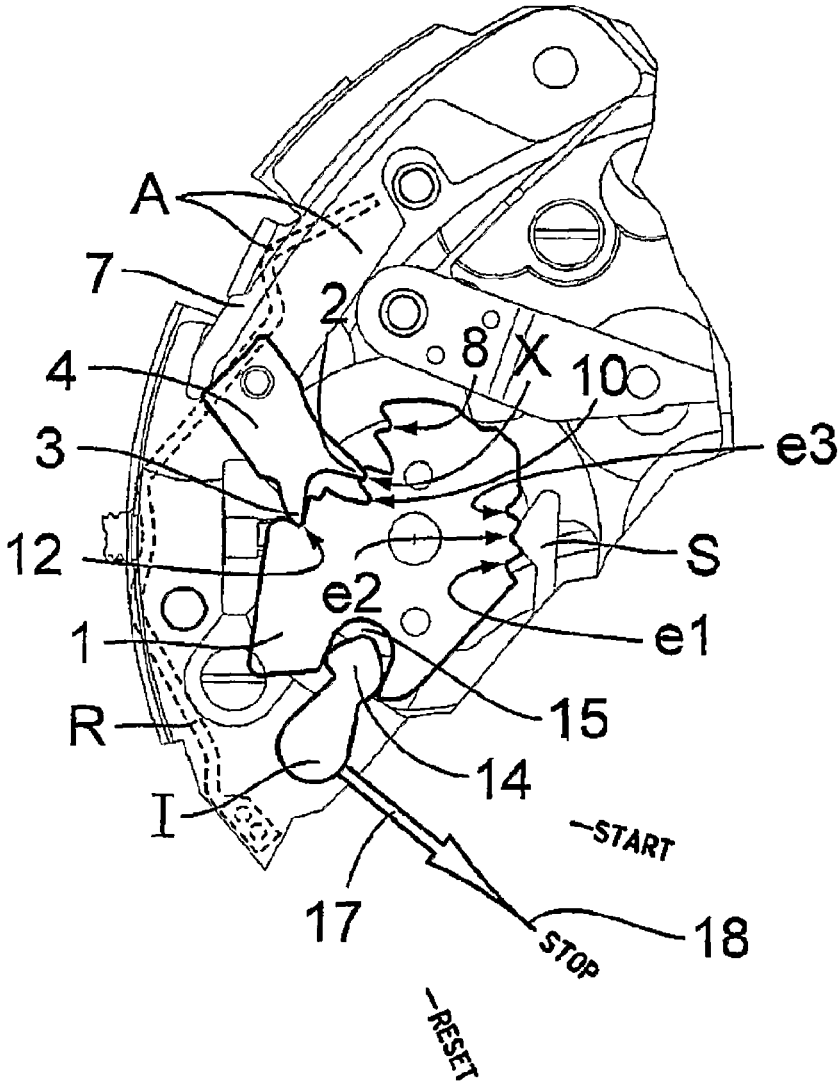
FIG. 19 illustrates a variant of the chronograph control mechanism in the stopped position.

In stopped position, pusher A recessed, FIG. 19 illustrates a variant of the control device of a cam mono-pusher counter mechanism. In this variant, the thrust zone Z3 of the shuttle 1 comprises an additional slot X that works with the first nose 2 of the follower 4 to set the shuttle 1 very precisely in the stopping position of the chronograph so as to prevent any jumps, returns or rebounds of the shuttle when the pusher A is released and therefore to prevent any even weak ill-timed jump of the hand 17 at this time.

In this variant, the shuttle 1 therefore comprises 6 slots that work with the noses 2 and 3 of the follower 4. This additional slot X is located between the second slot 9 and the third slot 10 of the shuttle 1.

The invention claimed is:

1. A control mechanism for a simple three-cycle chronograph, comprising:

a single pusher (A), whereby said pusher comprises a follower (4) with two noses (2, 3) mounted to oscillate on the pusher (P) and subjected to an elastic return action (7), wherein the noses (2, 3) of the follower (4) work with slots (8, 9, 10, 11, 12) that a shuttle (1) comprises in its peripheral thrust zone (Z3), wherein said shuttle (1) is pivoted around its pivoting axis (0), and wherein between actuations of said shuttle (1) by the pusher, said shuttle (1) is kept in one of three angular positions, i) resetting to zero, ii) starting, and iii) stopping, by way of a jumper(s) working with three notches (e1, e2, e3) of the periphery of the shuttle (1), the whole being arranged such that for each depression that is exerted on the pusher (A), the shuttle (1) passes from one position to the next in its operating cycle, from resetting to zero during operation, then operating with stopping, and finally stopping with resetting to zero.

2. The control mechanism of a chronograph according to claim 1, wherein the thrust zone (Z3) of the shuttle comprises five slots (8, 9, 10, 11, 12) or six slots (8, 9, 10, 11, 12, X).

3. The control mechanism of a chronograph according to claim 1, wherein the second and third slots (9, 10) of the shuttle (1) have a rectilinear internal side and a concave external side.

4. The control mechanism of a chronograph according to claim 1, wherein the shuttle (1), in a control zone of a switch (z2), comprises a U-shaped cutaway (15) that works with the top (14) of a switch (I) that is pivoted around its shaft (13) and wherein this shaft (13) carries a hand (17) that is designed to work with a graduation (18) of a dial (16) that indicates the state in which the chronograph cover mechanism is found.

5. The control mechanism of a chronograph according to claim 1, wherein the shuttle (1) constitutes a portion of a chronograph cam of an ETA 7750 chronograph mechanism.

6. The control mechanism of a chronograph according to claim 1, wherein for each of the "thrust" or active positions of the pusher (A), the oscillating follower (4) is in contact by the two noses (2, 3) with the periphery of the shuttle (1) that locks the shuttle (1) in a given angular position.

7. A simple three-cycle chronograph mechanism, comprising a control mechanism according to claim 1.

8. The control mechanism of a chronograph according to claim 1, wherein each nose (2, 3) of the oscillating follower (4) of the pusher (A) comprises a rectilinear internal side and a convex external side.

9. The control mechanism of a chronograph according to claim 8, wherein the thrust zone (Z3) of the shuttle comprises five slots (8, 9, 10, 11, 12) or six slots (8, 9, 10, 11, 12, X).

10. The control mechanism of a chronograph according to claim 8, wherein the second and third slots (9, 10) of the shuttle (1) have a rectilinear internal side and a concave external side.

11. The control mechanism of a chronograph according to claim 8, wherein the shuttle (1), in a control zone of a switch (z2), comprises a U-shaped cutaway (15) that works with the top (14) of a switch (I) that is pivoted around its shaft (13) and wherein this shaft (13) carries a hand (17) that is designed to work with a graduation (18) of a dial (16) that indicates the state in which the chronograph cover mechanism is found.

12. The control mechanism of a chronograph according to claim 8, wherein for each of the "thrust" or active positions of the pusher (A), the oscillating follower (4) is in contact by the two noses (2, 3) with the periphery of the shuttle (1) that locks the shuttle (1) in a given angular position.

13. A timepiece, comprising:

a simple three-cycle chronograph, wherein said chronograph is controlled by a chronograph control mechanism according to claim 1, and wherein said chronograph comprises a maneuvering element (19) that passes through a box of the chronograph in an airtight way and acts on the pusher (A) of the control mechanism.

14. The timepiece according to claim 13, wherein the maneuvering element (19) is located at 2 o'clock, and wherein the maneuvering element (19) acts directly on the pusher (A) of the chronograph control mechanism.

15. The timepiece according to claim 13, wherein the maneuvering element (19) is located at 3 o'clock, concentrically to a winder rod of the timepiece, and wherein the maneuvering element (19) acts on the pusher (A) of the chronograph mechanism by means of a lever (L).

16. The timepiece according to claim 13, further comprising:

a dial (16) equipped with a display of the state of the chronograph that comprises a graduation (18) carried by the dial (16) that works with a hand (17) driven by the shuttle (1) of the control mechanism of the chronograph.

* * * * *